US006783730B2

(12) United States Patent
Lin et al.

(10) Patent No.: US 6,783,730 B2
(45) Date of Patent: Aug. 31, 2004

(54) AL-NI-MN CASTING ALLOY FOR AUTOMOTIVE AND AEROSPACE STRUCTURAL COMPONENTS

(75) Inventors: Jen C. Lin, Export, PA (US); Vadim S. Zolotorevsky, Moscow (RU); Michael V. Glazoff, Pittsburgh, PA (US); Shawn J. Murtha, Monroeville, PA (US); Nicholas A. Belov, Moscow (RU)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/325,561

(22) Filed: Dec. 20, 2002

(65) Prior Publication Data

US 2003/0152478 A1 Aug. 14, 2003

Related U.S. Application Data

(60) Provisional application No. 60/345,182, filed on Dec. 21, 2001.

(51) Int. Cl.[7] ..... C22C 21/00

(52) U.S. Cl. ..... 420/550; 420/551; 420/553

(58) Field of Search ..... 420/550, 551, 420/553

(56) References Cited

U.S. PATENT DOCUMENTS 6,306,342 B2 * 10/2001 Koch et al. ..... 420/543

OTHER PUBLICATIONS

"ASM Specialty Handbook: Aluminum and Aluminum Alloys", ASM International, 1993, p. 41.*

* cited by examiner

*Primary Examiner*—George Wyszomierski
*Assistant Examiner*—Janelle Morillo
(74) *Attorney, Agent, or Firm*—Gary P. Topolosky; Edmond S. Mikach

(57) ABSTRACT

There is claimed an Al—Ni—Mn based alloy for die casting, squeeze casting, permanent mold casting, sand casting and/or semi-solid metal forming. The composition of this alloy includes, by weight percent: about 2–6% Ni, about 1–3% Mn, less than about 1% Fe, less than about 1% Si, the balance Al, incidental elements and impurities. It is suitable for aerospace and automotive cast parts.

19 Claims, No Drawings

AL-NI-MN CASTING ALLOY FOR AUTOMOTIVE AND AEROSPACE STRUCTURAL COMPONENTS

RELATED APPLICATIONS

This application claims the benefit of U.S. Provisional Patent Application Ser. No. 60/345,182 filed on Dec. 21, 2001 and entitled "An Al—Ni—Mn Casting Alloy for Automotive and Aerospace Structural Components", the disclosure of which is fully incorporated by reference herein.

FIELD OF THE INVENTION

This invention relates to the field of aluminum-based casting alloys. It further relates to automotive and aerospace parts made from such alloys.

BACKGROUND OF THE INVENTION

Most aluminum casting alloys need to be solution heat treated, quenched, and artificially aged to achieve adequate properties for automotive and aerospace structural applications. The processes of solution heat treating and quenching not only increase operational and capital costs but also induce part distortion, which then requires adding a straightening step to the overall manufacturing process. That straightening step is time-consuming and a high cost operation that greatly limits the applications of cast Al alloys.

Recently, some non-heat treatable (or "NHT") alloys were developed and implemented in production. Those alloys can be used in either an F-temper or T5 condition. Unfortunately, those alloys tend to have much less castability than alloys required in a T6-type temper.

SUMMARY OF THE INVENTION

The present invention consists of an Al—Ni—Mn based alloy for die casting, squeeze casting, permanent mold casting, sand casting and/or semi-solid metal forming. Preferred embodiments of this alloy include the following compositional additions, all in weight percent; about 2–6% Ni, about 1–3% Mn, less than about 1% Fe, less than about 1% Si, the the balance Al, incidental elements and impurities. On a more preferred basis, this alloy composition consists essentially of about 3.5–4.5% Ni, about 1.5–2.5% Mn, less than about 0.1% Fe, less than about 0.1% Si, less than about 0.15% Ti, and less than about 0.03% B, the balance Al and incidentals.

DESCRIPTION OF PREFERRED EMBODIMENTS

When referring to any numerical range of values herein, such ranges are understood to include each and every number and/or fraction between the stated range minimum and maximum. A range of about 0.5–6 wt. % nickel, for example, would expressly include all intermediate values of about 0.6, 0.7 and 0.9% Ni, all the way up to and including 5.95, 5.97 and 5.99 wt. % nickel. The same applies to each other numerical property and/or elemental range set forth herein.

The invention alloy decribed herein has the following benefits: (a) excellent castability including high fluidity and low hot cracking tendency, properties which are not found in other NHT Al alloys; and (b) good tensile properties without any heat treatments. The alloy composition of this invention eliminates the need for SHT, quench and aging processes, while also showing good fracture toughness in the as-cast condition.

Several alloy compositions were comparatively cast, using permanent mold castings, from which the following properties were measured:

TABLE 1

Mechanical Properties (Tensile), Hardness (HB) and Hot Cracking Index (HCI) for Several Al-Ni-Mn Alloys in As-Cast Condition

| Samp # | Composition | UTS (Mpa) | YS (Mpa) | % Elong | HB | HCI, mm |
|---|---|---|---|---|---|---|
| 1 | Al-2Ni-2Mn-0.1Ti-0.02B | 159 | 82 | 24 | 56 | 4 |
| 2 | Al-2.5Ni-2Mn0.3Zr-0.3Cr | 180 | 100 | 17 | 65 | 4 |
| 3 | Al-4Ni-2Mn-0.1Ti-0.02B | 208 | 129 | 16 | 62 | <4 |

Another set of alloy compositions was comparatively cast and evaluated. The results of Kahn Tear tests performed thereon were as follows:

TABLE 2

Kahn Tear testing of Two Preferred Embodiments

| Alloy | Composition | UPE (KJ/m2) |
|---|---|---|
| 1 | Al-3.85 Ni-1.91 Mn-0.02 Ti-0.002B | 90 |
| 2 | Al-3.88 Ni-1.98 Mn-0.1 Ti-0.02B | 115 |

From this table, it was concluded that lower titanium and/or boron contents had a negative impact on Kahn Tear properties.

The influence of nickel on hot cracking index (HCI) and mechanical properties of several individually cast compositions containing 2% Mn (as-cast) was then mapped for comparison. Also included were representative samples of cast alloy A356 (Aluminum Association designation).

TABLE 3

Ni content effect on Hot Cracking Index (HCI) and Mechanical Properties (Tensile) and % Elongation

| | | Before corrosion test | | After corrosion test | |
|---|---|---|---|---|---|
| % Ni | HCI, mm | UTS MPa | Elong % | UTS MPa | Elong % |
| 0 | 12 | 98 | 36 | 101 | — |
| 0.5 | 4 | 121 | 9 | — | — |
| 1 | 4 | 146 | 13 | 141 | 16 |
| 2 | 4 | 170 | — | | |
| 4 | 4 | 201 | 8 | 191 | 7 |
| A356.0 | 4 | 186 | — | 169 | 6 |

From this table, it can be seen that a minimum of around 0.5 wt. % Ni is needed to achieve good castability (HCI=4 mm). In addition, this table showed that overall corrosion resistance does not appear to be significantly affected by total Ni content.

The role of ancillary elements on the mechanical properties (tensile testing) of Al—4Ni—2Mn alloy samples was next evaluated. For this comparison, all samples were machined from 22 mm diameter cast specimens.

TABLE 4

| Alloy | Composition | ## | Before corrosion test UTS, MPa | TYS, MPa | Elong., % | After corrosion test UTS, MPa | YS, MPa | Elong, % |
|---|---|---|---|---|---|---|---|---|
| A356.0 | 7Si 0.3Mg | 1 | 193 | 98 | 5.7 | 184 | 96 | 5.0 |
| | | 2 F temp | 193 | 106 | 5.7 | 170 | 112 | 4.0 |
| | | 3 F temp | 192 | 105 | 6.0 | 164 | 103 | 4.7 |
| | | 4 F temp | 185 | 94 | 6.7 | 168 | 98 | 4.7 |
| | | avg | 191 | 101 | 6.0 | 172 | 102 | 4.6 |
| A | 2Ni2Mn0.1Ti(B) | 1 | 157 | 82 | 20.0 | 148 | 79 | 17.0 |
| | | 2 F temp | 154 | 81 | 20.7 | 151 | 84 | 22.7 |
| | | 3 F temp | 152 | 79 | 24.3 | 154 | 83 | 20.7 |
| | | 4 F temp | 153 | 79 | 20.7 | 152 | 84 | 19.7 |
| | | avg | 154 | 80 | 21.4 | 151 | 83 | 20.0 |
| B | 4Ni2Mn0.1Ti(B) | 1 | 174 | 103 | 17.3 | 170 | 98 | 15.0 |
| | | 2 F temp | 173 | 97 | 18.0 | 171 | 95 | 17.3 |
| | | 3 F temp | 177 | 95 | 15.6 | 169 | 91 | 13.0 |
| | | 4 F temp | 172 | 95 | 15.0 | 170 | 101 | 16.0 |
| | | avg | 174 | 98 | 16.5 | 170 | 96 | 15.3 |
| C | 2Ni2Mn0.1Ti(B) + 0.2Fe0.1Si | 1 | 168 | 81 | 18.3 | 159 | 79 | 15.3 |
| | | 2 F temp | 163 | 81 | 18.3 | 159 | 94 | 17.7 |
| | | 3 F temp | 168 | 84 | 19.7 | 153 | 82 | 13.3 |
| | | 4 F temp | 159 | 81 | 16.0 | 155 | 81 | 15.7 |
| | | avg | 165 | 82 | 18 | 157 | 84 | 16 |

From this data, it was observed that higher strengths can be achieved via higher Ni contents but that no significant change in overall corrosion resistance was found.

TABLE 5

Effect of Ancillary elements in 4% Ni, 2% Mn Invention alloys

| Comp. | Fe | Si | Ti | B | TYS MPa | UTS MPa | Elong % | HCI mm | UPE KJ/m2 |
|---|---|---|---|---|---|---|---|---|---|
| A-1 | <0.05 | <0.05 | 0.0 | 0.0 | — | — | — | 4 | |
| 2 | <0.05 | <0.05 | 0.05 | 0.01 | — | — | — | 4 | |
| 3 | <0.05 | <0.05 | 0.1 | 0.02 | 99 | 199 | 16 | 4 | 80 |
| 4 | <0.05 | 0.1 | 0.1 | 0.02 | 96 | 201 | 15 | 6 | 62 |
| 5 | <0.05 | 0.3 | 0.1 | 0.02 | 96 | 209 | 13 | 6 | 46 |
| 6 | <0.05 | 0.5 | 0.1 | 0.02 | 98 | 217 | 12 | 10 | 40 |
| 7 | <0.05 | 0.7 | 0.1 | 0.02 | 93 | 181 | 5 | 14 | 34 |
| 8 | <0.05 | 0.9 | 0.1 | 0.02 | 93 | 201 | 7 | >16 | 32 |
| B-1 | 0.1 | <0.05 | 0.1 | 0.02 | 100 | 201 | 11 | 4 | |
| 2 | 0.2 | <0.05 | 0.1 | 0.02 | 94 | 193 | 15 | <6 | |
| 3 | 0.2 | 0.1 | 0.1 | 0.02 | | | | 4 | |
| 4 | 0.3 | 0.1 | 0.1 | 0.02 | | | | 4 | |
| 5 | 0.3 | 0.2 | 0.1 | 0.02 | | | | 6 | |
| 6 | 0.5 | 0.2 | 0.1 | 0.02 | | | | <6 | |
| 7 | 0.7 | 0.2 | 0.1 | 0.02 | | | | 6 | |
| 8 | 0.9 | 0.2 | 0.1 | 0.02 | | | | 10 | |

From this data, it was interpreted that hot cracking tendencies (as evidenced by larger HCI values) tended to increase with increasing Si content. Hot cracking tendencies are relatively less sensitive to Fe contents, as compared to Si levels. Finally, the elongation and propagation energy values decrease with increasing Si content.

A more preferred alloy composition according to this invention consists essentially of: about 3.7–4.2 wt. % Ni, about 1.7–2.2 wt. % Mn, up to about 0.1 wt % Fe and up to about 0.1 wt. % Si, about 0.08–0.15 wt. % Ti, about 0.01–0.03 wt. % B, the balance aluminum.

Having described the presently preferred embodiments, it is to be understood that the invention may be otherwise embodied within the scope of the appended claims.

What is claimed is:

1. An aluminum casting alloy composition that includes: about 2–6 wt % Ni, about 1–3 wt. % Mn, less than about 1 wt. % Fe, less than about 1 wt. % Si, with incidental elements and impurities.

2. The alloy composition of claim 1 which contains about 3.5–4.5 wt. % Ni.

3. The alloy composition of claim 2 which contains about 3.7–4.2 wt. % Ni.

4. The alloy composition of claim 1 which contains about 1.5–2.5 wt. % Mn.

5. The alloy composition of claim 4 which contains about 1.7–2.2 wt. % Mn.

6. The alloy composition of claim 1 which contains less than about 0.3 wt. % Ti.

7. The alloy composition of claim 1 which contains less than about 0.06 wt. % B.

8. The alloy composition of claim 1 which contains up to about 0.25 wt % Fe.

9. The alloy composition of claim 8 which contains up to about 0.1 wt % Fe.

10. The alloy composition of claim 1 which contains up to about 0.25 wt. % Si.

11. The alloy composition of claim 10 which contains up to about 0.1 wt. % Si.

12. An aerospace structural component cast from an alloy composition that includes: about 2–6 wt. % Ni, about 1–3 wt. % Mn, less than about 1 wt. % Fe, less than about 1 wt. % Si, the balance aluminum, incidental elements and impurities.

13. The aerospace component of claim 12 wherein said composition contains about 3.5–4.5 wt. % Ni, about 1.5–2.5 wt. % Mn, up to about 0.25 wt. % Fe, up to about 0.25 wt. % Si, about 0.08–0.15 w. % Ti, up to about 0.05 wt. % B, the balance aluminum, incidental elements and impurities.

14. The aerospace component of claim 13 wherein said composition contains about 3.7–4.2 wt. % Ni, about 1.7–2.2 wt. % Mn, up to about 0.1 wt. % Fe, up to about 0.1 wt. % Si, about 0.08–0.15 wt. % Ti, about 0.01–0.03 wt. % B, the balance aluminum, incidental elements and impurities.

15. An automotive structural component cast from an alloy composition that includes: about 2–6 wt. % Ni, about 1–3 wt. % Mn, less than about 1.0 wt. % Fe, less than about 1.0 wt. % Si, the balance aluminum, incidental elements and impurities.

16. The automotive component of claim 15 wherein said composition contains about 3.5–4.5 wt. % Ni, about 1.5–2.5 wt. % Mn, up to about 0.25 wt. % Fe, up to about 0.25 wt. % Si, about 0.08–0.15 wt. % Ti, and up to about 0.05 wt. % B, the balance aluminum, incidental elements and impurities.

17. The automotive component of claim 15 wherein said composition contains about 3.7–4.2 wt. % Ni, about 1.7–2.2 wt. % Mn, up to about 0.1 wt. % Fe, up to about 0.1 wt. % Si, about 0.08–0.15 wt. % Ti and about 0.01–0.03 wt. % B, the balance aluminum, incidental elements and impurities.

18. The aerospace structural component of claim 12 wherein said composition contains less than about 0.3 wt. % Ti, and less than about 0.06 wt. % B.

19. The automotive structural component of claim 15 wherein said composition contains less than about 0.3 wt. % Ti and less than about 0.06 wt. % B.

* * * * *

UNITED STATES PATENT AND TRADEMARK OFFICE
Certificate

Patent No. 6,783,730 B2

Patented: August 31, 2004

ON petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jen C. Lin, Export, PA (US); Vadim S. Zolotorevsky, Moscow (RU); Michael V. Glazooff, Pittsburgh, PA (US); Shawn J. Murtha, Monroeville, PA (US); Nicholas A. Belov, Moscow (RU); Holger Haddenhorst, Gelsenkirchen (DE); and Frank Klueppel, Medebach (DE).

Signed and Sealed this Fifth Day of July 2011.

ROY KING
*Supervisory Patent Examiner*
Art Unit 1733
Tecnology Center 1700